United States Patent [19]

Doyle

[11] Patent Number: 4,678,119

[45] Date of Patent: Jul. 7, 1987

[54] ABRASIVE SLURRY SUPPLY SYSTEM FOR USE IN METALLOGRAPHIC SAMPLE PREPARATION

[75] Inventor: Ralph R. Doyle, Des Plaines, Ill.

[73] Assignee: Buehler Ltd., Lake Bluff, Ill.

[21] Appl. No.: 765,049

[22] Filed: Aug. 12, 1985

Related U.S. Application Data

[63] Continuation of Ser. No. 433,834, Oct. 12, 1982, abandoned.

[51] Int. Cl.[4] ..... B05B 7/24; B24C 7/00

[52] U.S. Cl. ..... 239/9; 239/124; 239/310; 239/337; 51/436; 406/85; 406/146

[58] Field of Search ..... 239/9, 10, 337, 366, 239/372, 373, 124, 127, 418; 51/410, 436, 438, 321, 317, 316, 283; 406/12, 85, 146; 222/318, 373, 424

[56] References Cited

U.S. PATENT DOCUMENTS

| | | | |
|---|---|---|---|
| 1,194,520 | 8/1916 | Lewis | 51/283 |
| 2,018,543 | 10/1935 | Buirk | 137/212 X |
| 2,719,390 | 10/1955 | Jones | 51/283 X |
| 2,743,554 | 5/1956 | Dailey et al. | 51/321 X |
| 2,876,601 | 3/1959 | McFaddon | 51/410 X |
| 3,019,522 | 2/1962 | Bluth et al. | 51/283 X |
| 3,070,924 | 1/1963 | Hastrup | 51/438 X |
| 3,205,620 | 9/1965 | Woodworth et al. | 51/410 |
| 3,405,601 | 10/1968 | Clarke | 137/212 X |
| 4,044,507 | 8/1977 | Cox et al. | 51/321 X |
| 4,428,165 | 1/1984 | Dhlakia | 51/283-R |
| 4,484,418 | 11/1984 | Reich et al. | 51/283 R |

*Primary Examiner*—Andres Kashnikow
*Assistant Examiner*—Kevin Patrick Weldon
*Attorney, Agent, or Firm*—Charles F. Pigott, Jr.

[57] ABSTRACT

An abrasive slurry supply system for use in conjunction with a polisher or grinder or the like for preparing the surface of a metallurgical specimen, the system comprising an abrasive slurry reservoir, a first source of air under pressure connected with the reservoir to force the slurry to a spray nozzle, and a second source of air under pressure connected to the nozzle to transform the slurry from a liquid to an atomized mist which is directed to a rotatable platen or lapping wheel of the polisher/grinder machine for use in the preparation of metallurgical specimens.

9 Claims, 1 Drawing Figure

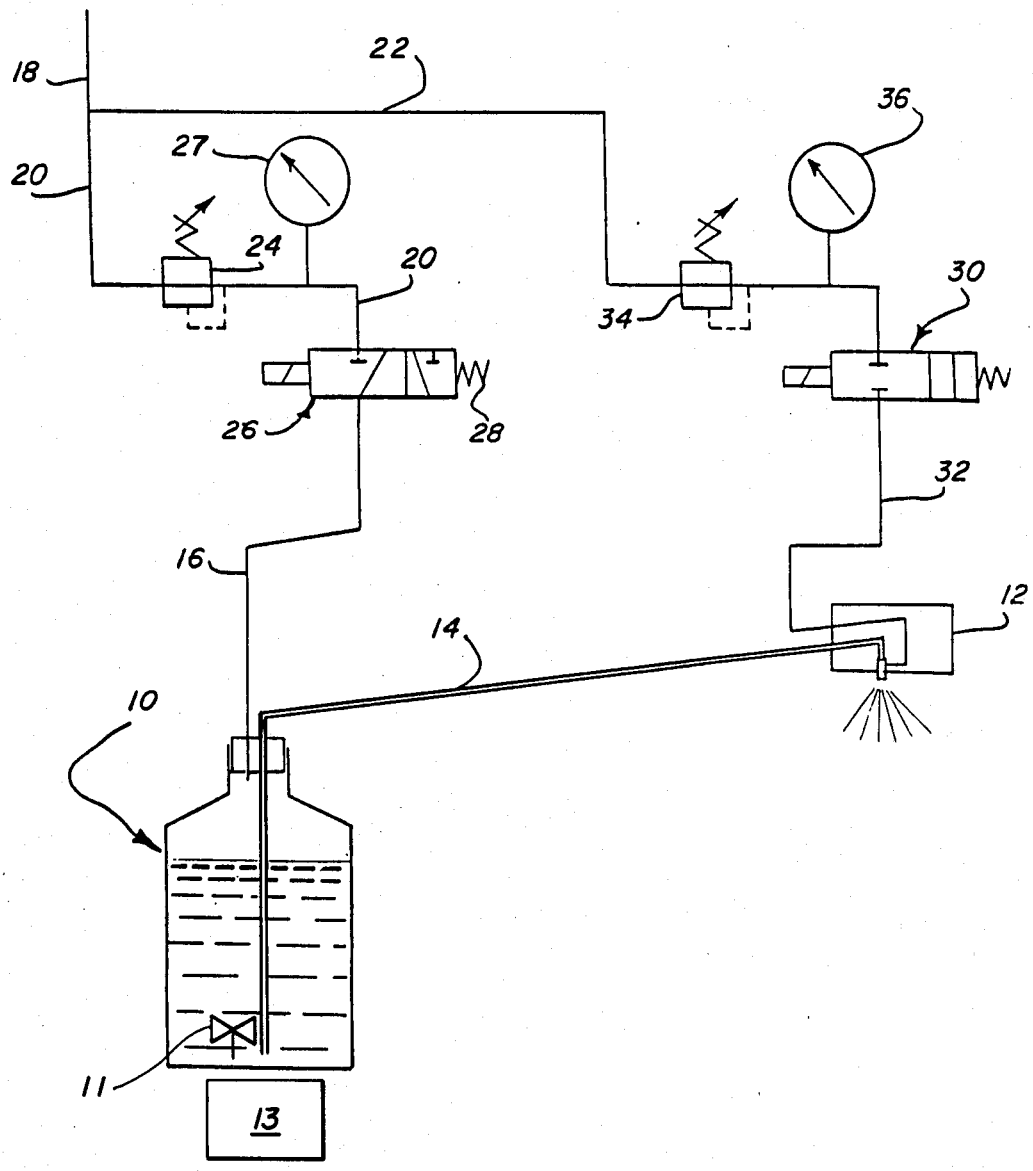
18
22
36
27
20
24
20
34
30
26
28
32
16
12
14
10
11
13

ABRASIVE SLURRY SUPPLY SYSTEM FOR USE IN METALLOGRAPHIC SAMPLE PREPARATION

This is a continuation of application Ser. No. 433,834, filed Oct. 12, 1982, now abandoned.

BRIEF SUMMARY OF THE INVENTION

The present invention relates to a system for creating a diamond slurry mist for use in the preparation of metallurgical specimens, such as by supplying such diamond slurry mist to a rotatable lapping wheel for use in diamond power lapping of the surfaces of metallurgical specimens.

It is known in the art to utilize diamond slurry in the form of a mist for the diamond power lapping of metallurgical specimens. However, conventional systems for producing such a slurry mist normally include a diamond slurry reservoir, in conjunction with a siphon tube, and a pump which produces a stream of high pressure air past the upper end of the siphon tube to draw diamond slurry up out of the reservoir and produce a mist which may be sprayed to a lapping wheel or the like for use in the preparation of metallurgical specimens.

Such known pump/siphon systems have significant disadvantages when used to supply diamond slurry. One disadvantage is the requirement that the air pump which produces a stream of high pressure air for the siphoning operation must be located relatively close to the reservoir and the nozzle, for the reason that such siphon tubes can only draw slurry through relatively short distances such as 12 inches. Thus, with such conventional systems it is normally not feasible to locate the slurry reservoir and the pump remote from the location of the polisher, grinder or lapping machine.

Another disadvantage of known pump/siphon type diamond slurry supply systems is that with such a system the siphon tube is substantially filled with the slurry solution at all times, even when the slurry is not being supplied to the lapping machine or the like, with the result there is a tendency for the diamond abrasive to settle out of the solution and cause clogging of the tubing.

It is an object of the present invention to provide a diamond slurry supply system which eliminates the need for a siphon tube and instead utilizes air under pressure to force diamond solution out of a reservoir and supply it to a nozzle where it is transformed to a mist for spraying to a lapping wheel or the like.

Another object of the invention is to provide a diamond slurry supply system as above-mentioned where the pump and the slurry reservoir may be located remote from the polisher, grinder or lapping machine, such as in a separate cabinet.

A further object of the invention is to provide a diamond slurry supply system where the air under pressure to the slurry reservoir is disconnected from the reservoir and the reservoir is vented to atmosphere when the system is not used to supply slurry, thereby permitting the supply line from the reservoir to the nozzle to drain back into the reservoir. As a result, the diamond abrasive is not permitted to settle out in the supply line, but rather is continuously mixed in the reservoir.

The foregoing and other objects and advantages of the invention will be apparent from the following description of a preferred embodiment, taken in conjunction with the accompanying drawing.

DESCRIPTION OF THE DRAWING

The drawing is a pneumatic schematic drawing showing the main components of the diamond slurry supply system of the present invention.

Now, in order to acquaint those skilled in the art with the manner of making and using the invention, there is described, in conjunction with the accompanying drawing, a preferred embodiment of the invention.

DETAILED DESCRIPTION OF THE INVENTION

Referring now to the drawing, there is shown a bottle or reservoir 10 for containing a supply of diamond slurry of known type comprising crushed diamond in suspension with a liquid to form a slurry used in a lapping operation or the like to remove material from the surface of an object. As indicated above, the present system is intended for use with a grinder, polisher or lapping machine for preparation of the surface of metallurgical specimens.

It is preferred that the reservoir 10 include stirring means (not shown) within the reservoir for keeping the diamond slurry in an agitated or mixed condition to prevent the crushed diamond from settling out. By way of example, such stirring means may comprise a known form of magnetic stirring rod 11 located within the reservoir and controlled by permanent magnet means 13 located beneath the reservoir. While the foregoing stirring means is not itself a part of the present invention, it is important in understanding the present system to recognize that the diamond slurry within the reservoir 10 is maintained in an agitated or mixed condition.

A nozzle 12 is provided to receive diamond slurry from the reservoir 10 and mix it with air under pressure to create a diamond mist which is sprayed to an adjacent lapping wheel or the like (not shown) for use in the lapping of metallurgical specimens. A tube 14 projects down into the reservoir 10 and connects with the nozzle 12 for the purpose of carrying diamond slurry solution from the reservoir to the nozzle. Air under pressure is supplied through an air tube 16 to the reservoir 10 for the purpose of forcing diamond slurry from the reservoir through the tube 14 to the nozzle 12. The mechanism for controllng the supply of such air will be described below.

An air source is shown at 18 for supplying air to a pair of supply lines 20 and 22 at a pressure which may vary between 10 psi. and 100 psi. The air line 20 includes a pressure regulator 24 to control the pressure of air supplied to the reservoir to 10 psi. so as to avoid damage to the reservoir through excess pressure. An air gauge 27 is provided to indicate the pressure in the line 20 on the outlet side of regulator 24. The air line 20 leads to a valve 26 which in turn is connected with the air line 16 leading to the reservoir 10 as described above.

The valve 26 is a three-way solenoid valve biased by a spring 28 an an "exhaust" position shown in the drawing where supply line 20 is closed and line 16 from the reservoir 10 is vented to atmosphere. In a second position of the valve 26, line 20 is connected with the line 16 so air under pressure is supplied to reservoir 10 to force diamond slurry solution through line 14 to nozzle 12. It should be understood that the diamond slurry remains in liquid form until it is mixed with air under pressure by the nozzle 12 and thereby transformed into a diamond mist for spraying on the lapping wheel of a lapping machine of the like.

The second air line 22 leads to a valve 30, and the latter supplies air to the nozzle 12 through an air line 32. The air line 22 includes a pressure regulator 34 and an air gauge 36. The air regulator 34 controls the pressure of air supplied to nozzle 12 through line 32, and in accordance with the preferred embodiment being described, such pressure is in the range of 10 to 15 psi.

The valve 30 is a two-way solenoid valve having a closed position and an open position. In the closed position shown in the drawing, air line 22 is closed, and in the open position the line 22 is connected with line 32 to supply air under pressure to nozzle 12 to mix with the diamond slurry solution from supply line 14 and create a diamond mist for spraying to a lapping wheel or the like.

It is an important advantage of the present invention that the solenoid valve 26 is normally biased to a position where bottle or reservoir 10 is vented to atmosphere. As a result, whenever the slurry supply system is turned off by disconnecting the supply of air under pressure to the reservoir 10 and nozzle 12, valve 26 will be moved to the position shown in the drawing thereby venting reservoir 10 to atmosphere. As a result, any slurry in supply line 14 between reservoir 10 and nozzle 12 will be permitted to drain back into the reservoir where it will continuously be agitated and mixed. On the other hand if such slurry were permitted to remain in the supply line, it would give the crushed diamond a chance to settle out of the solution and thereby cause clogging of the line.

It is also an important advantage of the slurry supply system of the present invention that by utilizing positive air pressure to force the liquid slurry solution from the reservoir 10, it is not necessary to locate the pump close to the reservoir or to the nozzle, nor is it necessary that the reservoir be located close to the nozzle. Thus, the pump and reservoir may conveniently be located in a cabinet remote from the spray nozzle 12 and from the rotatable platen of the sample preparation machine.

In the use of the slurry dispensing system of the present invention, it should be understood that it is normally not necessary to have a continuous supply of diamond slurry to a lapping wheel or the like during the preparation of metallurgical specimens. In a typical use of the present invention, the "on-time" or duration of time during which slurry is being dispensed is variable from 0.5 second to 10 seconds, and the "off-time" or time between dispending cycles is variable from 1 to 30 seconds, preferably 4 seconds to 20 seconds. The minimum interval of "off-time" is set at 4 seconds so that all of the slurry contained in the tube 14 between the reservoir 10 and the nozzle 12 has an opportunity to drain back into the reservoir when the latter is vented to atmosphere as described above. Such drainage prevents abrasive particles in the slurry from settling out and causing blockage problems.

What is claimed is:

1. A method of supplying abrasive slurry to a lapping, polishing or grinding machine for preparing the surface of a metallurgical specimen, the method comprising, in combination, providing a container of abrasive slurry and connecting said container by an upwardly inclined conduit to a nozzle, supplying air under pressure through a first air passage to said container to force abrasive slurry through said upwardly inclined conduit to said nozzle, supplying air under pressure through a second air passage to said nozzle to mix air under pressure with said abrasive slurry at said nozzle to create an abrasive slurry mist, intermittently disconnecting said first air passage from said contained and, with each disconnecting step, simultaneously venting said container to atmosphere to permit abrasive slurry in said inclined conduit to drain back to said container, and substantially continuously mixing the abrasive slurry in said container.

2. A method as defined in claim 1 where said slurry is dispensed intermittently for an "on" time of 0.5 second to 10 seconds and said first air passage is disconnected and said container is vented to atmosphere for an "off" time of 1 second to 30 seconds.

3. A method as defined in claim 1 where said abrasive slurry is a diamond slurry so said nozzle produces a diamond mist when air under pressure is mixed with said slurry.

4. A method as defined in claim 1 including the step of regulating the air pressure of air supplied to said container through said first air passage so said air pressure does not exceed 10 psi.

5. A method as defined in claim 1 including the step of regulating the air pressure of air supplied to said nozzle through said second air passage so said pressure is in the range of 10 to 15 psi.

6. A method as defined in claim 2 where said "off" time is 4 seconds to 20 seconds.

7. A method of supplying diamond slurry to a lapping, polishing, or grinding machine for preparing the surface of a metallurgical specimen, the method comprising, in combination, providing a container of diamond abrasive slurry and connecting said container by an upwardly inclined conduit to a nozzle, supplying air under pressure through a first air passage to said container to force diamond slurry through said upwardly inclined conduit to said nozzle, supplying air under pressure through a second air passage to said nozzle to mix air under pressure with said diamond slurry at said nozzle to create a diamond mist, intermittently disconnecting said first air passage from said container and simultaneously venting said container to atmosphere to permit diamond slurry in said inclined conduit to drain back to said container, and substantially continuously mixing said diamond slurry in said container, said diamond slurry being dispensed intermittently during a given "on" time and said first air passage being disconnected and said container being vented to atmosphere during a given "off" time, said "on" time being 0.5 seconds to 10 seconds and said "off" time being 1 second to 30 seconds.

8. A method as defined in claim 7 where said "off" time is 4 seconds to 20 seconds.

9. A method of applying diamond slurry to a lapping, polishing or grinding machine for preparing the surface of a metallurgical specimen, the method comprising, in combination, providing a container of diamond slurry and connecting said container by an upwardly inclined conduit to a nozzle, supplying air under pressure not exceeding 10 psi through a first air passage to said container to force said diamond slurry through said upwardly inclined conduit to said nozzle, supplying air under pressure in the range of 10 psi to 15 psi through a second air passage to said nozzle to mix air under pressure with diamond slurry at said nozzle to create a diamond mist, intermittently disconnecting said first air passage from said container and simultaneously venting said container to atmosphere to permit diamond slurry in said inclined conduit to drain back to said container, and substantially continuously mixing said diamond slurry in said container, said diamond slurry being dispensed intermittently for a given "on" time of 0.5 second to 10 seconds and said first air passage being disconnected and said container being vented to atmosphere for a given "off" time of 4 seconds to 20 seconds.

* * * * *